United States Patent [19]

Wakamiya

[11] Patent Number: 4,658,614

[45] Date of Patent: Apr. 21, 1987

[54] SHAPE CONTROL APPARATUS FOR FLAT MATERIAL

[75] Inventor: Yoshinori Wakamiya, Nishinomiya, Japan

[73] Assignee: Mitsubishi Denki Kabushiki Kaisha, Tokyo, Japan

[21] Appl. No.: 727,563

[22] Filed: Apr. 26, 1985

[30] Foreign Application Priority Data

May 9, 1984 [JP] Japan ..... 59-94906

[51] Int. Cl.[4] ..... B21B 37/10

[52] U.S. Cl. ..... 72/8; 72/13; 72/200; 72/201; 72/243

[58] Field of Search ..... 72/11, 13, 8, 20, 200, 72/201, 243

[56] References Cited

U.S. PATENT DOCUMENTS

| | | | |
|---|---|---|---|
| 3,927,545 | 12/1975 | Morooka | 72/13 X |
| 3,990,284 | 11/1976 | Barton | 72/13 X |
| 4,274,273 | 6/1981 | Fapiano et al. | 72/13 |
| 4,392,367 | 7/1983 | Bald | 72/13 X |

FOREIGN PATENT DOCUMENTS

| | | | |
|---|---|---|---|
| 0112110 | 8/1980 | Japan | 72/13 |
| 0156822 | 9/1982 | Japan | 72/13 |
| 58-47245 | 10/1983 | Japan . | |

*Primary Examiner*—Lowell A. Larson
*Assistant Examiner*—Steve Katz
*Attorney, Agent, or Firm*—Leydig, Voit & Mayer

[57] ABSTRACT

A rolling mill shape control apparatus for a flat material comprises a thermal crown calculator which calculates a thermal crown magnitude in a widthwise direction of rolls as based on rolling history information after a change in vertical spacing of the rolls, a roll wear calculator which calculates a wear magnitude of the rolls as based on rolling history information after the rearrangement of the rolls, an optimum rolling temperature distribution calculator which calculates an optimum rolling temperature distribution in a widthwise direction of the flat material on the basis of the calculated results of both the thermal crown calculator and the roll wear calculator and a reference bending force corresponding to maximum bending correction, a thermometer which detects a widthwise temperature distribution of the flat material, a heating/cooling device which can separately heat/cool a plurality of parts of the flat material divided in the widthwise direction thereof, and a heating/cooling controller which compares an optimum rolling temperature distribution signal and a temperature distribution signal so as to control the heating/cooling device between the signals.

2 Claims, 8 Drawing Figures

SHAPE CONTROL APPARATUS FOR FLAT MATERIAL

BACKGROUND OF THE INVENTION

This invention relates to a shape control apparatus for flat material, and more particularly to a shape control apparatus which can form hot rolled steel into an acceptable shape.

As a control apparatus of this type, there has heretofore been generally known apparatus wherein the temperature distribution of a hot rolled steel plate in the widthwise direction thereof is measured to determine a widthwise load distribution which in turn, is used to operate controllers such as a roll bending device and a roll coolant device to produce rolled products with an acceptable shape from flat material.

In conventional shape control apparatus of this type, however, no consideration is given to the thermal crown which varies with time, and the roll wear. These are important factors in shape forming and, as a result, the failure to consider these factors leads to the disadvantage that defective shapes arise as time passes or as the number of rolled products increases.

SUMMARY OF THE INVENTION

This invention has the object of eliminating such disadvantages, and relates to a shape control apparatus for flat material in which the optimum rolling temperature distribution of the flat material in the widthwise direction thereof is calculated from a thermal crown magnitude and a roll wear magnitude in the widthwise direction of the rolls which are, in turn, determined from rolling history information after a change in the vertical spacing of the rolls. The shape control apparatus also uses a reference bending force reflecting a maximum bending correction magnitude. The optimum rolling temperature distribution and the temperature distribution in the widthwise direction of the flat material located on the incoming side of a rolling mill are compared and the differences determined, and a heating-/cooling device installed on the incoming side of the rolling mill and capable of separately heating or cooling divisions of the flat material in the widthwise direction thereof is controlled according to such differences so as to control the shape of the flat material, whereby flat material of acceptable shape including the leading portion thereof can be produced even when the number of rolled products increases and time intervals occur between products, which affect the rolling temperature.

The reason why a reference bending force reflecting a maximum bending correction magnitude is employed in this invention is that, since a bending device is operated by an ordinary feedback loop in the shape control of flat material or steel plate, the maximum manipulated variable should desirably be secured.

DETAILED DESCRIPTION OF THE INVENTION

The principle of this invention is as described below.

Figure 2:
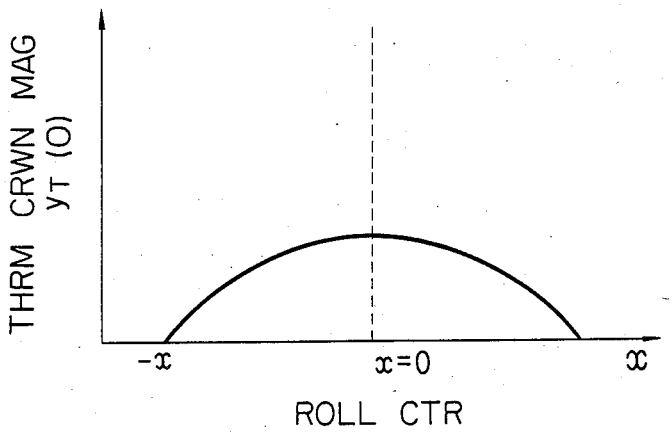
FIG. 2 is a graph showing the thermal crown magnitude of rolls in the widthwise direction of a flat material.
Figure 3:
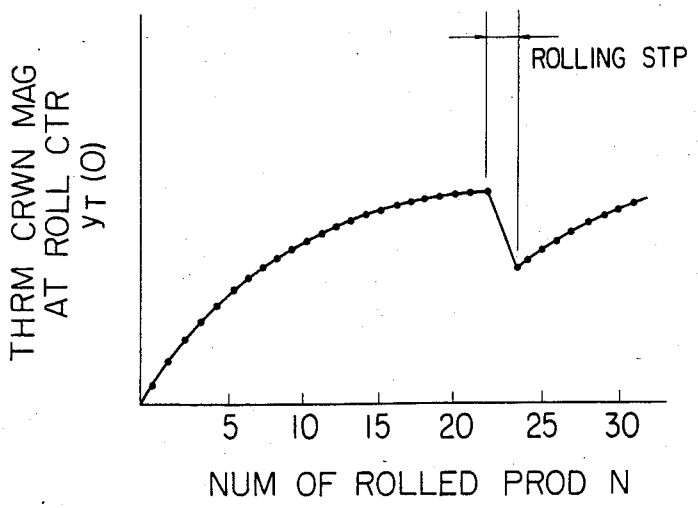
FIG. 3 is a graph showing the relationship between the thermal crown magnitude at the center of the rolls in the lengthwise direction and the number of rolled products.

An arbitrary time after the rearrangement of rolls in a hot rolling line, the thermal crown magnitude $y_T(x)$ of the rolls is symmetric with respect to the center of the rolls in the lengthwise direction thereof and can be substantially expressed by a quadratic equation as illustrated in FIG. 2. Illustrated as a function of rolling time or the number of rolled products, the thermal crown magnitude $y_T(O)$ at the roll center is as illustrated in FIG. 3. From FIG. 3 it can be seen that:

(1) The thermal crown magnitude changes rapidly after the rearrangement of the rolls.

(2) As the rolling proceeds, the change in the thermal crown magnitude becomes slower.

(3) When a rolling interval such as rolling cessation is introduced of a long duration, the thermal crown magnitude decreases because of a decrease in the temperature of the rolls, and is changed rapidly again after rolling resumes followig the interval.

In view of the above, the thermal crown magnitude $y_T(x)$ is expressed by the following equation on the basis of the number N of rolled products and the rolling time interval between the rolling of products after a change in the vertical spacing of the rolls:

$$y_T(x)=(A_Tx^2+B_Tx+C_T)\cdot\{1-\exp(-D_T\cdot N_E)\} \quad (1)$$

$$N_E=(N_E^{N-1}+1)\cdot\exp(-E_T\tau) \quad (2)$$

where $y_T(x)$ the thermal crown magnitude of the rolls, x the coordinate value of the rolls in the longitudinal direction thereof, $A_T$, $B_T$, $C_T$, $D_T$, $E_T$ constants, $N_E$ the equivalent number of rolled products, $N_E^{N-1}$ the equivalent number of rolled products preceding by one product, $\tau$ the period of time of a rolling interval since the rolling of the preceding product.

Figure 4:
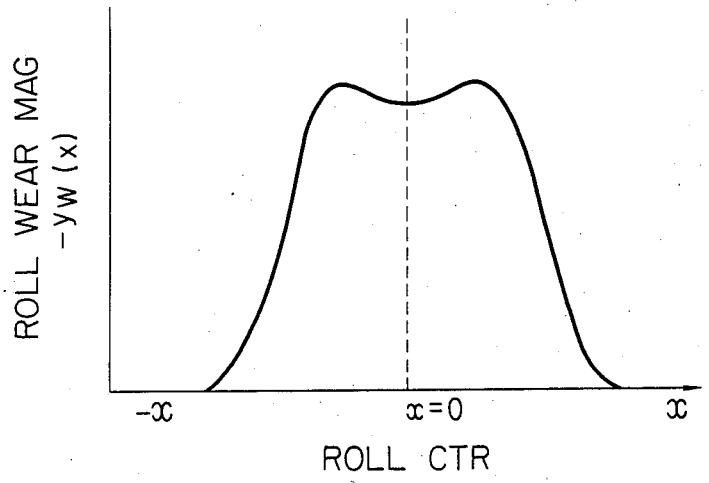
FIG. 4 is a graph showing the wear magnitude of the rolls in the widthwise direction of the flat material.

Next, a roll wear magnitude $y_W(x)$ will be described. Roll wear magnitude is also symmetric with respect to the roll center, as illustrated in FIG. 4, and at an arbitrary time after a change in the vertical spacing it can be expressed by a biquadratic equation.

Figure 5:
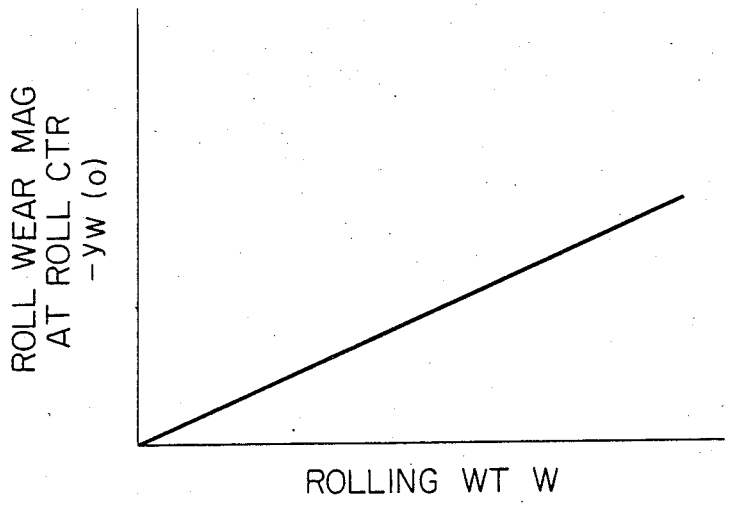
FIG. 5 is a graph showing the relationship between the roll wear magnitude at the roll center and the rolling weight.

In addition, when the wear magnitude $y_W(O)$ at the roll center is plotted against a rolling weight W after a change in the vertical spacing of the rolls, a substantially proportional relation exists and is illustratively shown in FIG. 5.

In view of the above, the roll wear magnitude $y_W(x)$ can be expressed by the following equation on the basis of the rolling weight W after a change in the vertical spacing of the rolls:

$$-y_W(x)=(A_Wx^4+B_Wx^3+C_Wx^2+D_Wx+E_W)*W \quad (3)$$

where $y_W(x)$ roll wear magnitude, $A_W$, $B_W$, $C_W$, $D_W$, $E_W$ constants, W rolling weight after the change in vertical spacing of the rolls.

Next, the curvature magnitude of rolling mill rolls will be described. Usually, a dynamic equation concerning the roll curvature is expressed by the following:

$$\frac{d^2y_B}{dx^2} = \frac{P(x)}{E \cdot I} + \frac{1}{\alpha \cdot G \cdot A} \cdot \frac{d^2P(x)}{dx^2} \quad (4)$$

where $Y_B$ the curvature magnitude of a roll axis,

E the modulus of longitudinal elasticity of the rolls,

I the second moment of area of the rolls, $\alpha$ constant,

G the modulus of transverse elasticity of the rolls,

A the cross-sectional area of the rolls,

P(x) distributed rolling load in the axial direction of the rolls. In order to solve Eq. (4), the load distribution P(x) and boundary conditions may be given.

Figure 6:
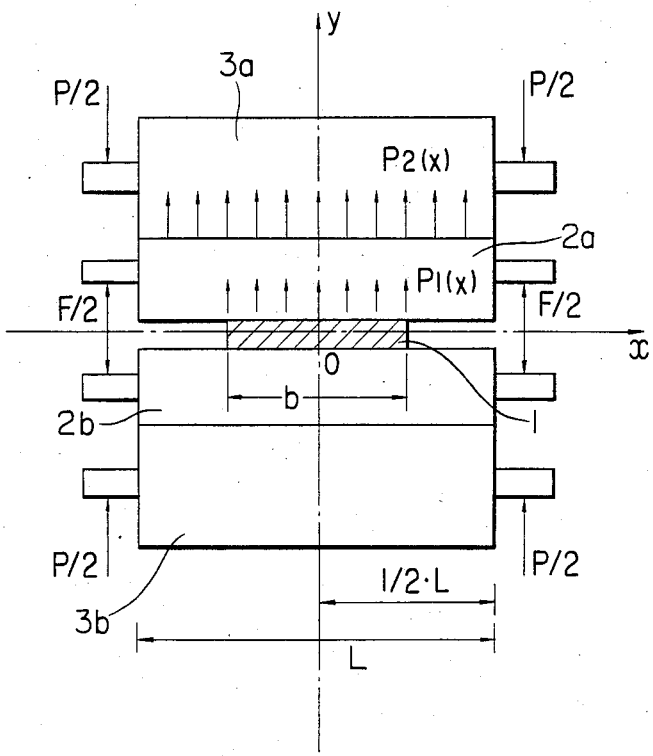
FIG. 6 is an explanatory diagram showing the load distribution of a rolling mill in the state in which rolls curve.

FIG. 6 shows a rolling load distribution in a quadruple rolling mill in the state in which rolls curve. In FIG. 6, the x-axis represents coordinates in the direction of a roll axis (in the widthwise direction of a flat material), while the y-axis represents coordinates indicative of the curvature of the roll axis.

A flat material 1 is rolled by upper and lower work rolls 2*a* and 2*b*. Under this condition, a load distribution $P_1(x)$ arises between the flat material 1 and the upper work roll 2*a*. Simultaneously, a load distribution $P_2(x)$ arises between the upper work roll 2*a* and an upper backup roll 3*a*. Letter P in the figure indicates a rolling force which is detected by a load detector producing force-representing signals processed in the apparatus, and letter F a bending force which acts between the upper and lower work rolls 2*a* and 2*b*. Thus, the difference between the load P and bending force F is the rolling weight W.

When the balance of the forces is considered in FIG. 6, $$P - F = \int_{-\frac{1}{2}b}^{\frac{1}{2}b} P_1(x)\,dx = w \quad (5)$$

where b the width of the flat material.

$P_1(x)$ can be evaluated by knowing the widthwise temperature distribution of the flat material 1:

$$P_1(x) = K\sqrt{R' \cdot \Delta h \cdot Q_p} \quad (6)$$

$$K = K_o \cdot \dot{\epsilon}^n \cdot \epsilon^m \cdot \exp\frac{\alpha}{T(x)} \quad (7)$$

where

R′ deviating roll radius,

Δh rolling reduction,

Qp reduction force function,

K deformation resistance, $K_o$, n, m, $\alpha$ constants, $\epsilon$ strain, $\dot{\epsilon}$ strain velocity, T temperature.

In addition, when the load distribution between the upper work roll 2*a* and the upper backup roll 3*a* is indicated and the balance of the forces is considered:

$$P = \int_{-\frac{1}{2}L}^{\frac{1}{2}L} P_2(x)\,dx \quad (8)$$

holds where

L the length of the rolls.

Figure 7:
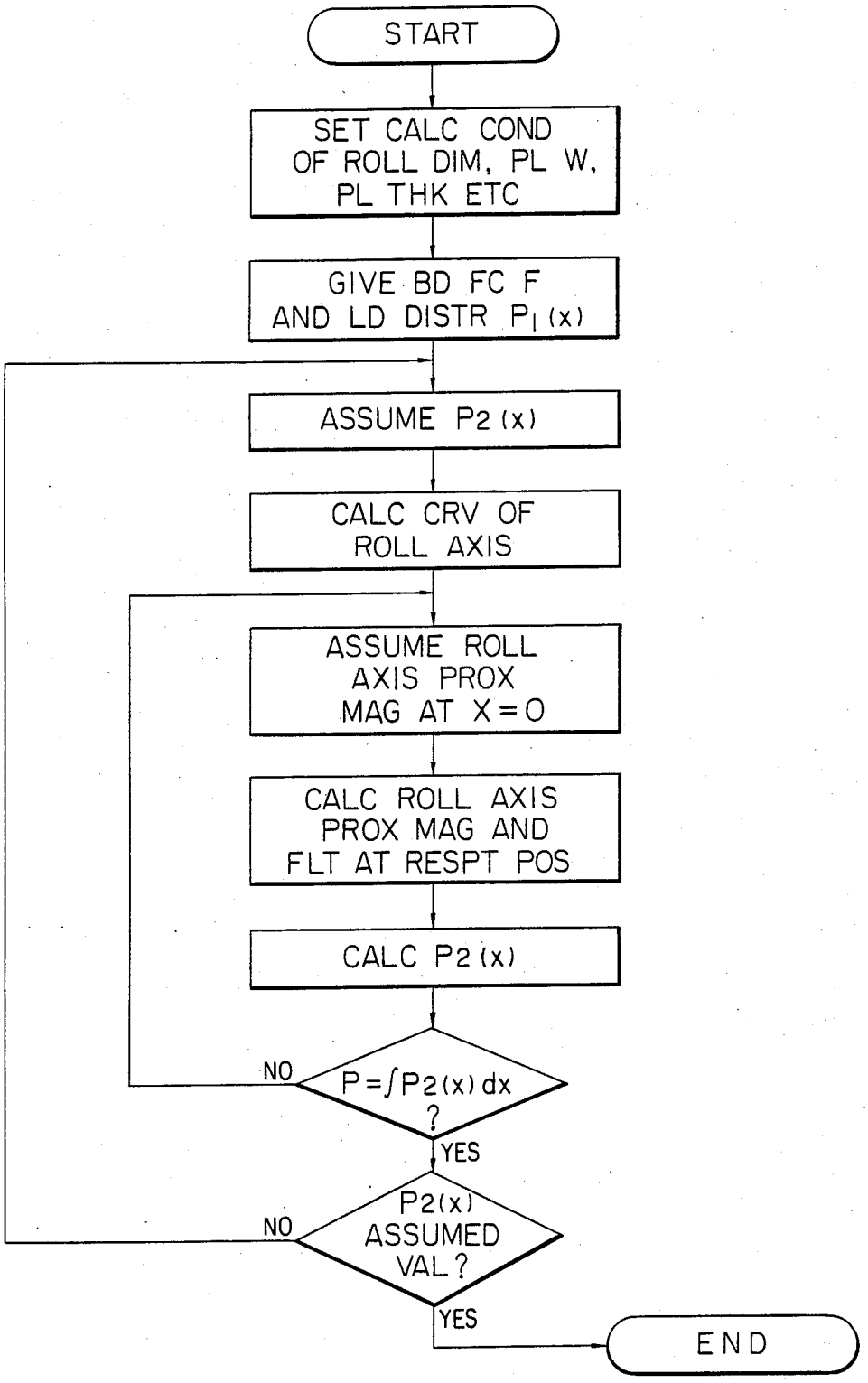
FIG. 7 is a flow chart for computing the curvature magnitude of the rolls.

In general, Eq. (4) can be numerically solved by computing apparatus utilizing processing steps of the flow chart shown in FIG. 7.

As stated before, when the rolling load distribution $P_1(x)$ is obtained, the roll curvature $y_B$ can be computed. It is therefore necessary to know the temperature distribution of the flat material in the widthwise direction thereof.

The widthwise temperature distribution of the flat material or steel plate in the hot rolling line can be expressed by the following quadratic equation in the light of the fundamental equation of thermal conduction:

$$T(x)=T_o-a\cdot x^2 \quad (9)$$

where $T_o$ plate temperature at the center in the widthwise direction of the plate, x distance (coordinate) from the center of the width of the plate, a constant.

This can be computed by measuring the temperatures of at least two points including the center of the width of the plate and producing temperature-representing signals which are processed in the apparatus.

In principle, according to the present invention is an optimum rolling temperature distribution in the widthwise direction of the steel plate produces an acceptable shape of the leading portion of the steel plate under a reference bending force $F_0$. A reference bending force $F_0$ of maximum bending correction magnitude is used in a feedback shape control. The optimum rolling temperature distribution is obtained with the aforementioned equations (1)–(9) and used to control a heating/cooling device.

In judging the shape of the plate to be acceptable, the total value y(x) is considered among the aforementioned three of the computed thermal crown value $Y_T(x)$, the computed roll wear value $y_W(x)$ and the computed roll curvature magnitude value $y_B(x)$:

$$y(x)=y_T(x)-y_W(x)+y_B(x) \quad (10)$$

A criterion at which the square deviation of the total value from x=0 is minimized, is provided and is defined as the optimum bending force $F_{OPT}$:

$$J = \min \int_{-\frac{1}{2}L}^{\frac{1}{2}L} [y(0) - y(x)]^2\,dx \quad (11)$$

Figure 8:
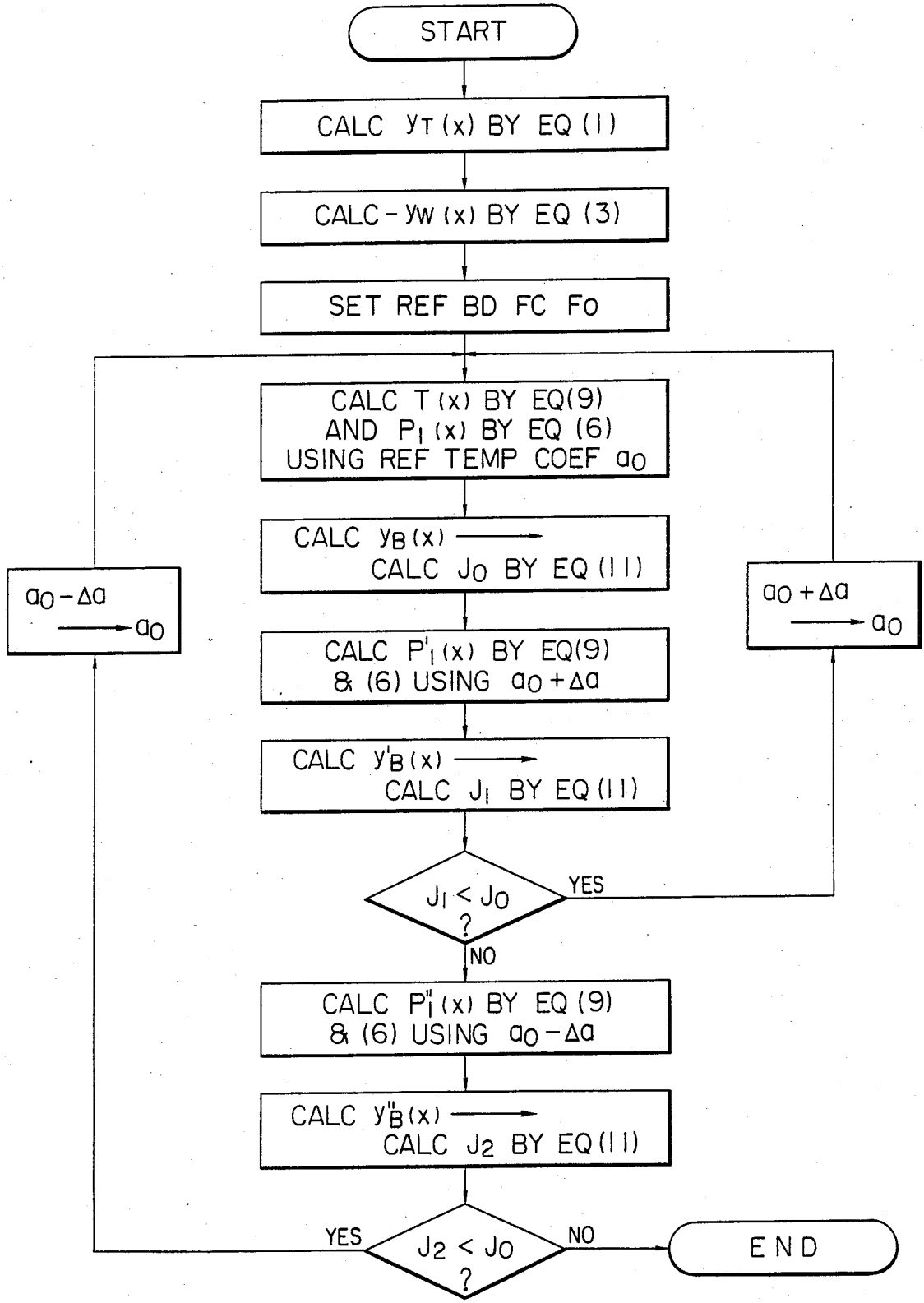
FIG. 8 is a flow chart for computing an optimum bending force.

The optimum bending force $F_{OPT}$ can be computed in accordance with a flow chart shown in FIG. 8.

Figure 1:
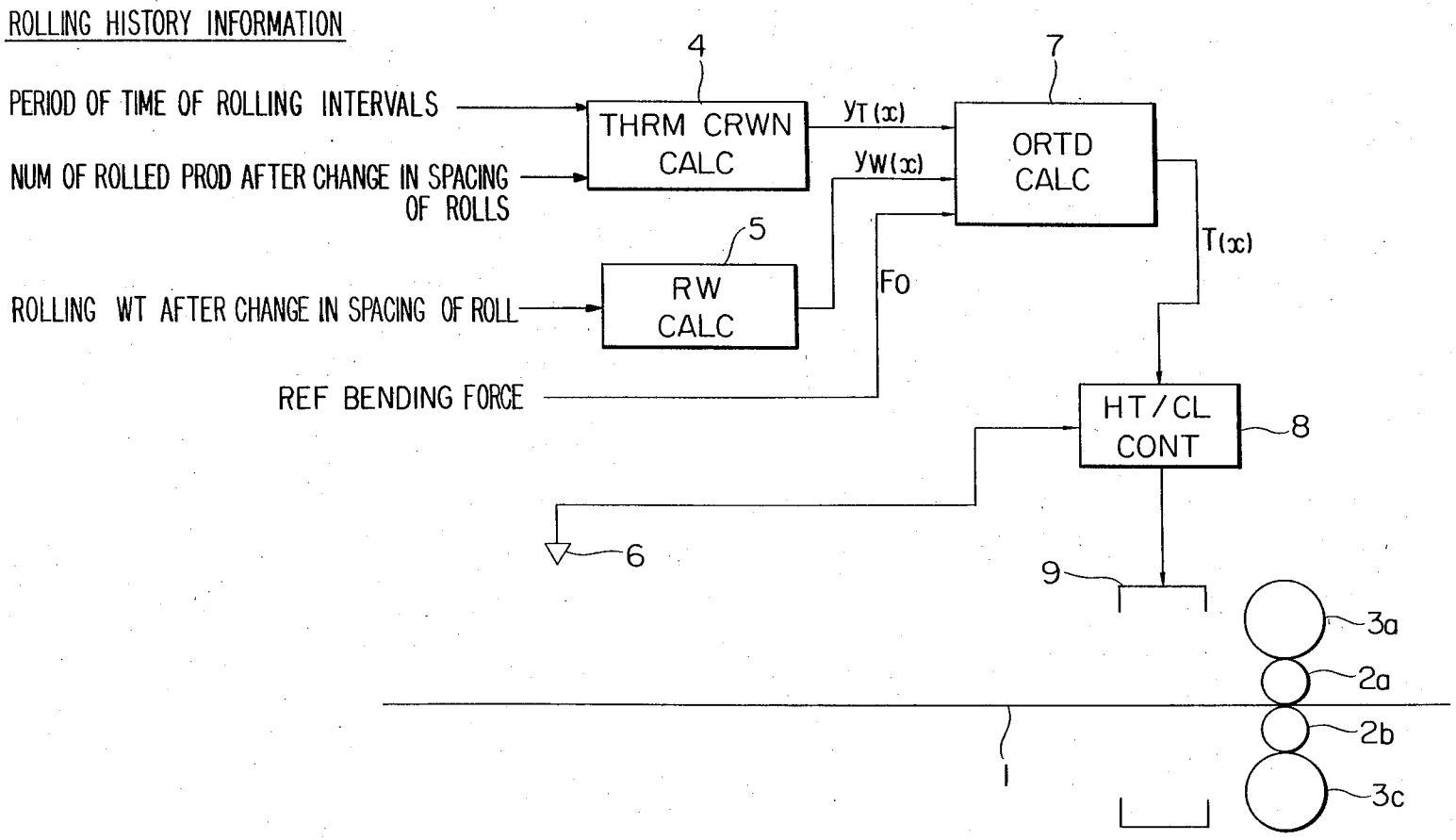
FIG. 1 is a block diagram of a shape control apparatus embodying this invention.

Now, one embodiment of this invention will be described with reference to FIG. 1.

Referring to the figure, numeral 1 designates a flat material or steel plate, symbols 2*a* and 2*b* upper and lower work rolls, and symbols 3*a* and 3*b* upper and lower backup rolls. A thermal crown magnitude calculating means, herein shown as a calculator 4, receives data in the form of signals representing measurements of the period of time of the rolling interval between a number of rolled products and the count of number of rolled products after the change in vertical spacing of the rolls and computes $y_T(x)$ in accordance with Eq. (1). A roll wear calculating means, herein shown as a roll wear calculator (5), receives hysteresis data in the form of signals representing measurements of the rolling weight to determine the wear magnitude after the change in vertical spacing of the rolls and computes $y_W(x)$ in accordance with Eq. (3). Both quantities $y_T(x)$ and $y_W(x)$ are determined only once before the steel plate 1 is rolled into the rolling mill toward the rolls.

A thermometer 6 is installed on the incoming side of the rolling mill, and it measures the temperature at a plurality of points, preferably at least three points in the widthwise direction of the steel plate 1 so as to detect the temperature distribution in the widthwise direction and produces signals representing temperature. An optimum rolling temperature distribution determining means, herein shown as calculator 7, receives the output values $y_T(x)$ and $Y_W(x)$ of the respective calculator means 4 and 5 and the reference bending force $F_0$, and determines the optimum rolling temperature distribution in the widthwise direction of the plate in accordance with the flow chart of FIG. 8, this optimum distribution being determined by substituting the reference temperature coefficient $a_0$ into Eq. (9).

Shown at numeral 8 is a heating/cooling controller which compares the optimum rolling temperature distribution provided from the calculator means 7 and the temperature distribution derived from the signals produced by the thermometer 6 and determines the differences between them so as to control a heating/cooling device 9 according to the differences. The heating-/cooling device 9 is installed between the thermometer 6 and the rolling mill, and it can separately heat/cool a plurality of divisions of the material, preferably at least three divisions into which the steel plate 1 is divided widthwise.

The above series of computations are performed at the point in time at which the steel plate 1 has passed the thermometer 6. The heating/cooling controller 8 is completely set before the steel plate 1 passes the heating/cooling device 9.

Thus, the embodiment establishes the optimum rolling temperature rendering the shape of the leading portion of the steel plate acceptable at the reference bending magnitude adapted to maximize the bending correction magnitude, by also considering the thermal crown magnitude, wear magnitude and curvature of the rolls based on the rolling history information after the change in vertical spacing of the rolls, so that an acceptable shape is provided, not only at the leading portion of the steel plate, but also throughout the steel plate.

As set forth above, according to this invention, the optimum rolling temperature distribution of the flat material in the widthwise direction thereof is determined on the basis of a thermal crown magnitude and a roll wear magnitude in the widthwise direction of rolls from rolling history information after the rearrangement of the rolls and a reference bending force reflecting a maximum bending correction magnitude, the optimum rolling temperature distribution and a temperature distribution in the widthwise direction of the flat material part located on the incoming side of a rolling mill are compared to find the differences therebetween, and a heating/cooling device installed on the incoming side of the rolling mill and capable of separately heating-/cooling a plurality of divisions of the flat material in the widthwise direction thereof is controlled according to such differences so as to control the shape of the flat material, so that a flat material having an acceptable shape can always be produced in the leading portion of the flat material and throughout the flat material even when the number of rolled products increases or when rolling is stopped for intervals.

What is claimed is:

1. A shape control apparatus for producing rolled products from flat material and having rolls for shaping said material, said shape control apparatus comprising:

means for measuring temperatures of said material at a plurality of points in a widthwise direction in a leading portion of flat material entering said rolls and producing temperature-representing signals, a thermal crown calculating means having an input receiving product number signals representing count of rolled products from flat material rolled in said rolls and time interval signals representing rolling time intervals following rolling of a number of products and operable for making a first determination from said product number and interval-representing signals of and producing an output representing a thermal crown magnitude in a widthwise direction of said rolls after a change in the vertical spacing of said rolls following rolling of a number of rolled products, a roll wear calculating means having an input receiving rolling weight signals representing rolling weight of said rolls and operable for making a second determination from said rolling weight-representing signals of and producing an output representing roll wear magnitude in a widthwise direction of said rolls from rolling history information of said rolls after a change in the vertical spacing of the rolls following rolling of a number of rolled products, an optimum rolling temperature distribution determining means connected to receive the outputs representing thermal crown magnitude, roll wear magnitude, and a reference bending force corresponding to a maximum bending force correction for an optimum rolling temperature distribution in a widthwise direction of flat materials entering said rolls, and operable for determining from the outputs and the reference bending force and producing an output representing an optimum rolling temperature distribution to be applied to the flat material, a heating/cooling device for heating and cooling a plurality of separate divisions of flat material divided widthwise and entering said rolls, and a controller for said device including means for comparing the output representing the optimum rolling temperature distribution with an output representing a temperature distribution signal from said temperature measuring means and determining any differences, and means for controlling said device to heat or cool said material to reduce such differences.

2. A shape control apparatus for a flat material as defined in claim 1 wherein said temperature measuring means comprises means for determining the widthwise temperature distribution from the measured temperature of at least three points in the widthwise direction of the flat material.

* * * * *